US007153626B2

(12) United States Patent
Foster et al.

(10) Patent No.: US 7,153,626 B2
(45) **Date of Patent: *Dec. 26, 2006**

(54) METHOD OF FORMING DYE DONOR ELEMENT

(75) Inventors: David G. Foster, West Henrietta, NY (US); Maurice L. Gray, Rochester, NY (US); Rajesh V. Mehta, Rochester, NY (US); Ramesh Jagannathan, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/135,263

(22) Filed: May 23, 2005

(65) Prior Publication Data

US 2006/0263713 A1 Nov. 23, 2006

(51) Int. Cl.

| | |
|---|---|
| ***G03C 11/22*** | (2006.01) |
| ***G03C 8/10*** | (2006.01) |
| ***B05D 1/02*** | (2006.01) |
| ***B41M 5/20*** | (2006.01) |
| ***B41M 5/24*** | (2006.01) |

(52) U.S. Cl. ..... 430/201; 430/338; 430/935; 430/964; 427/421.1; 428/32.6; 428/32.8; 503/227

(58) Field of Classification Search ..... 430/201, 430/338, 964, 935; 503/227; 428/32.6, 428/32.8; 427/421.1

See application file for complete search history.

(56) References Cited

U.S. PATENT DOCUMENTS

| | | | | |
|---|---|---|---|---|
| 4,582,731 | A | 4/1986 | Smith | |
| 4,734,227 | A | 3/1988 | Smith | |
| 4,743,451 | A | 5/1988 | Kalina | |
| 6,106,896 | A * | 8/2000 | Nielsen et al. | 427/195 |
| 6,471,327 | B1 | 10/2002 | Jagannathan et al. | |
| 6,752,484 | B1 | 6/2004 | Jagannathan et al. | |
| 6,866,371 | B1 | 3/2005 | Sadasivan et al. | |
| 2003/0222018 | A1 * | 12/2003 | Yonker et al. | 210/634 |
| 2003/0227502 | A1 | 12/2003 | Sadasivan et al. | |
| 2004/0109939 | A1 * | 6/2004 | Sadasivan et al. | 427/58 |
| 2005/0221018 | A1 * | 10/2005 | Mehta et al. | 427/458 |

FOREIGN PATENT DOCUMENTS

| | | |
|---|---|---|
| EP | 1236519 | 9/2002 |

OTHER PUBLICATIONS

Jean W. Thom, et al., "Particle Formation With Supercritical Fluids—A Review", 1991, J. Aerosol Sci, vol. 22, No. 5, pp. 555-584.

Rajesh V. Mehta, et al., "Process for the Formation of Particulate Material", filed as U.S. Appl. No. 10/814,354 on Mar. 31, 2004.

Rajesh V. Mehta, et al., "Process for the Deposition of Uniform Layer of Particulater Material", filed as U.S. Appl. No. 10/815,026 on Mar. 31, 2004.

* cited by examiner

*Primary Examiner*—Richard L. Schilling
(74) *Attorney, Agent, or Firm*—Lynne M. Blank; Kathleen Neuner Manne

(57) ABSTRACT

Methods of forming a dye donor layer of a dye-donor element for a thermal dye transfer system are described. The methods include coating colored particles in a compressed carrier fluid on the substrate of the dye-donor element.

7 Claims, No Drawings

METHOD OF FORMING DYE DONOR ELEMENT

FIELD OF THE INVENTION

Methods of forming dye-donor layers of thermal dye-donor elements used in thermal dye transfer systems using compressed fluids are disclosed.

BACKGROUND OF THE INVENTION

Thermal transfer systems have been developed to obtain prints from pictures that have been generated electronically, for example, from a color video camera or digital camera. An electronic picture can be subjected to color separation by color filters. The respective color-separated images can be converted into electrical signals. These signals can be operated on to produce cyan, magenta, and yellow electrical signals. These signals can be transmitted to a thermal printer. To obtain a print, a black, cyan, magenta, or yellow dye-donor layer, for example, can be placed face-to-face with a dye image-receiving layer of a receiver element to form a print assembly that can be inserted between a thermal print head and a platen roller. A thermal print head can be used to apply heat from the back of the dye-donor sheet, or to generate heat by means of radiation, such as with a laser. The process can be repeated as needed to print all colors. A color hard copy corresponding to the original picture can be obtained. Further details of this process and an apparatus for carrying it out are contained in U.S. Pat. No. 4,621,271 to Brownstein.

The dye donor layer of a thermal dye donor element can be prepared by standard coating or printing techniques, for example, gravure process, spin-coating, solvent-coating, extrusion coating, or other methods known to practitioners in the art. Other methods of forming the dye donor layer can include vacuum deposition as disclosed, for example, in U.S. Pat. Nos. 5,139,598 and 5,236,739, both to Chou et al.

Classic dye donor layer coating or printing techniques typically require the use of one or more of solvents, plasticizers, binders, or other additives to provide various characteristics, such as desired viscosity, adhesion, or crystallinity. This increases the cost and complexity of the dye donor layer.

SUMMARY OF THE INVENTION

The invention relates to methods of forming a dye donor element. The method can comprise obtaining a support, and coating the support with a colorant composition, wherein coating the support comprises depositing the colorant composition comprising a colorant and a compressed fluid carrier on the support.

ADVANTAGES

Coating the dye donor layer using a compressed fluid carrier simplifies the coating process, and reduces the number of components in the dye donor layer. These improvements can reduce material costs, processing costs, and capital costs, and can increase printing efficiency.

DETAILED DESCRIPTION OF THE INVENTION

A method of forming a dye donor layer for a thermal donor element is described, wherein the dye donor layer can be coated using a compressed fluid.

The dye-donor element can include a dye-donor layer. The dye-donor layer can include one or more colored areas (patches) containing dyes suitable for thermal printing. As used herein, a "dye" can be one or more dye, pigment, colorant, or a combination thereof, and can optionally be in a binder or carrier as known to practitioners in the art. During thermal printing, at least a portion of one or more colored areas can be transferred to the receiver element, forming a colored image on the receiver element. The dye-donor layer can include a laminate area (patch) having no dye. The laminate area can follow one or more colored areas. During thermal printing, the entire laminate area can be transferred to the receiver element. The dye-donor layer can include one or more colored areas and one or more laminate areas. For example, the dye-donor layer can include three color patches, for example, yellow, magenta, and cyan, and a clear laminate patch, for forming a three color image with a protective laminate layer on a receiver element.

Any dye transferable by heat can be used in the dye-donor layer of the dye-donor element. The dye can be selected by taking into consideration hue, lightfastness, and solubility of the dye in the dye donor layer binder and the dye image receiving layer binder. Examples of suitable dyes can include, but are not limited to, diarylmethane dyes; triarylmethane dyes; thiazole dyes, such as 5-arylisothiazole azo dyes; methine dyes such as merocyanine dyes, for example, aminopyrazolone merocyanine dyes; azomethine dyes such as indoaniline, acetophenoneazomethine, pyrazoloazomethine, imidazoleazomethine, imidazoazomethine, pyridoneazomethine, and tricyanopropene azomethine dyes; xanthene dyes; oxazine dyes; cyanomethylene dyes such as dicyanostyrene and tricyanostyrene dyes; thiazine dyes; azine dyes; acridine dyes; azo dyes such as benzeneazo, pyridoneazo, thiopheneazo, isothiazoleazo, pyrroleazo, pyraleazo, imidazoleazo, thiadiazoleazo, triazoleazo, and disazo dyes; arylidene dyes such as alpha-cyano arylidene pyrazolone and aminopyrazolone arylidene dyes; spiropyran dyes; indolinospiropyran dyes; fluoran dyes; rhodaminelactam dyes; naphthoquinone dyes, such as 2-carbamoyl-4-[N-(p-substituted aminoaryl)imino]-1,4-naphthaquinone; anthraquinone dyes; and quinophthalone dyes. Specific examples of dyes usable herein can include:

C.I. (color index) Disperse Yellow 51, 3, 54, 79, 60, 23, 7, and 141;

C.I. Disperse Blue 24, 56, 14, 301, 334, 165, 19, 72, 87, 287, 154, 26, and 354;

C.I. Disperse Red 135, 146, 59, 1, 73, 60, and 167;

C.I. Disperse Orange 149;

C.I. Disperse Violet 4, 13, 26, 36, 56, and 31;

C.I. Disperse Yellow 56, 14, 16, 29, 201 and 231;

C.I. Solvent Blue 70, 35, 63, 36, 50, 49, 111, 105, 97, and 11;

C.I. Solvent Red 135, 81, 18, 25, 19, 23, 24, 143, 146, and 182;

C.I. Solvent Violet 13;

C.I. Solvent Black 3;

C.I. Solvent Yellow 93; and

C.I. Solvent Green 3.

Further examples of sublimable or diffusible dyes that can be used include anthraquinone dyes, such as Sumikalon Violet RS® (product of Sumitomo Chemical Co., Ltd.), Dianix Fast Violet 3R-FS® (product of Mitsubishi Chemical Corporation.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5 GH® (product of Mitsui Toatsu Chemicals, Inc.); direct dyes such as Direct Dark Green B® (product of Mitsubishi Chemical Corporation) and Direct Brown M® and Direct Fast Black D® (products of Nippon Kayaku Co. Ltd.); acid dyes such as Kayanol Milling Cyanine 5R® (product of Nippon Kayaku Co. Ltd.); and basic dyes such as Sumicacryl Blue 6G® (product of Sumitomo Chemical Co., Ltd.), and Aizen Malachite Green® (product of Hodogaya Chemical Co., Ltd.); magenta dyes of the structures

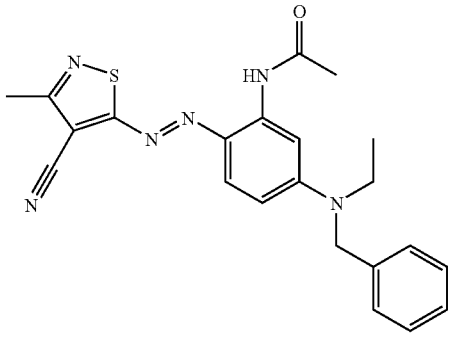

,

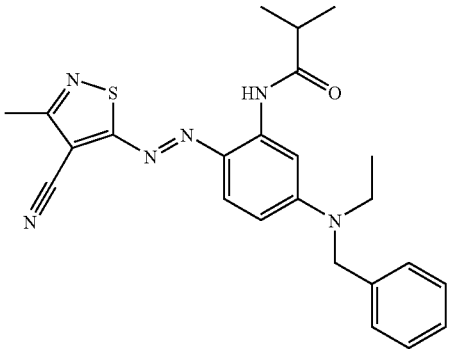

,

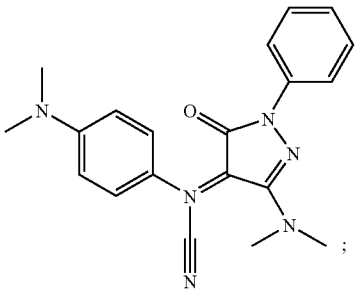

;

and cyan dyes of the structures

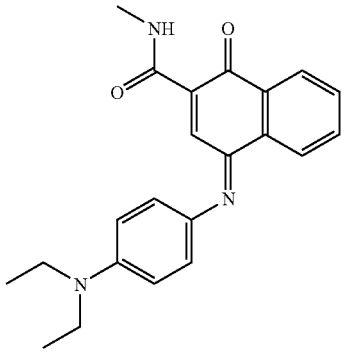

,

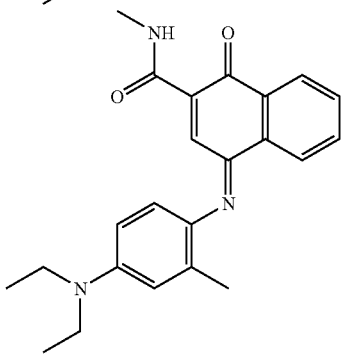

,

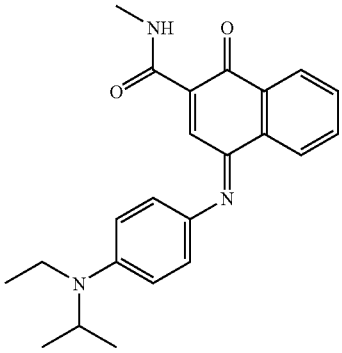

, and

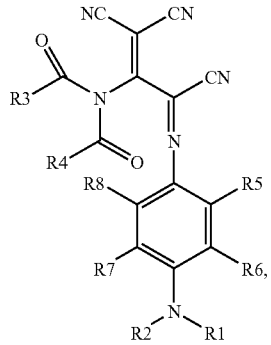

where R1 and R2 each independently represents an alkyl group, a cycloalkyl group, an aryl group, a heterocyclic group, or R1 and R2 together represent the necessary atoms to close a heterocyclic ring, or R1 and/or R2 together with R6 and/or R7 represent the necessary atoms to close a heterocyclic ring fused on the benzene ring; R3 and R4 each independently represents an alkyl group, or an alkoxy group; R5, R6, R7 and R8 each independently represents hydrogen, an alkyl group, a cycloalkyl group, an aryl group, an alkoxy group, an aryloxy group, a carbonamido group, a sulfamido group, hydroxy, halogen, $NHSO_2R_9$, $NHCOR_9$, $OSO_2R_9$, or $OCOR_9$, or R5 and R6 together and/or R7 and R8 together represent the necessary atoms to close one or more heterocyclic ring fused on the benzene ring, or R6 and/or R7 together with R1 and/or R2 represent the necessary atoms to close a heterocyclic ring fused on the benzene ring; and R9 represents an alkyl group, a cycloalkyl group, an aryl group and a heterocyclic group; and yellow dyes of the structures

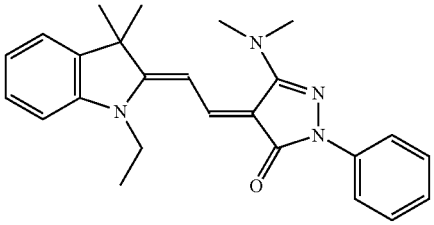

, and

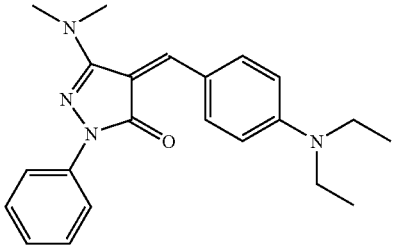

.

Further examples of useful dyes can be found in U.S. Pat. Nos. 4,541,830; 5,026,677; 5,101,035; 5,142,089; 5,804,531; and 6,265,345, and U.S. Patent Application Publication No. US 20030181331. Suitable cyan dyes can include Kayaset Blue 714 (Solvent Blue 63, manufactured by Nippon Kayaku Co., Ltd.), Phorone Brilliant Blue S—R (Disperse Blue 354, manufactured by Sandoz K. K.), and Waxoline AP-FW (Solvent Blue 36, manufactured by ICI). Suitable magenta dyes can include MS Red G (Disperse Red 60, manufactured by Mitsui Toatsu Chemicals, Inc.), and Macrolex Violet R (Disperse Violet 26, manufactured by Bayer). Suitable yellow dyes can include Phorone Brilliant Yellow S-6 GL (Disperse Yellow 231, manufactured by Sandoz K. K.) and Macrolex Yellow 6G (Disperse Yellow 201, manufactured by Bayer). The dyes can be employed singly or in combination to obtain a monochrome dye-donor layer or a black dye-donor layer. The dyes can be used in an amount of from 0.05 $g/m^2$ to 1 $g/m^2$ of coverage. According to various embodiments, the dyes can be hydrophobic.

The dye-donor layer of the dye-donor element can be formed or coated on a support. The colorant (dye or pigment) can be formed as a dye donor layer on the substrate using coating techniques such as Rapid Expansion of Supercritical Solvent ("RESS") and Supercritical Anti-Solvent ("SAS"). In both RESS and SAS, particles are formed using a compressed carrier, for example, a supercritical fluid such as but not limited to $CO_2$, $NH_3$, $H_2O$, $N_2O$, or ethane. In RESS, the particles are formed upon expansion of the compressed mixture through a nozzle or other release mechanism. Example of RESS coating methods can be found in U.S. Pat. Nos. 4,582,731; 4,734,227; and 4,743,451 to R. D. Smith, and in "Particle Formation with Supercritical Fluids—a Review," J. Aerosol. Sci. (1991) 22:555–584, by J. W. Tom et al. Additional information on exemplary RESS coating and printing techniques can be found in U.S. Pat. Nos. 6,471,327 and 6,752,484 to Jagannathan et al., U.S. Pat. No. 6,866,371 to Sadasivan et al., and U.S. Patent Application Publication No. US 2003/0227502 A1 to Sadasivan et al. In SAS, the compressed carrier functions as an antisolvent, extracting a solvent carrier from the colorant solution and forming colorant particles. Examples of SAS coating methods can be found in U.S. patent application Ser. Nos. 10/814,354 and 10/815,026, both to Mehta et al., and both filed Mar. 31, 2004. Although RESS and SAS are known for coating photographic and printing materials, no application of RESS or SAS coating to thermal donor formation is known.

If SAS coating is used, the solvent preferably has a high vapor pressure at low temperature. Suitable solvents can be selected based on ability to dissolve the desired material, miscibility with the compressed carrier, toxicity, cost, and other factors. Examples of suitable solvents can include, but are not limited to, ethanol, methanol, water, methylene chloride, acetone, toluene, dimethyl formamide, and tetrahydrofuran.

The dye-donor layer can be continuously coated or patch coated. A dye-donor layer can include one or more colors, and can include a laminate or overcoat composition.

The coated colorant particles can be less than 100 nanometers average diameter, for example, less than 50 nanometers, or less than 10 nanometers in size. The colorant particles can be applied directly to the substrate, or to an adhesive layer on the substrate. The thickness of the dye layer formed with the colorant particles can be from 1 nanometer to 1 micron.

The dye layer can be free of solvent, binder, plasticizer, or a combination thereof. Alternately, one or more of a binder, solvent, plasticizer, or combination thereof can be combined with the colorant, and then coated to form the dye donor layer. The coated particles can be less than 100 nanometers average diameter, for example, less than 50 nanometers, or less than 10 nanometers in size.

The dye-donor layer can have a dye to binder ratio for each color dye patch. For example, a yellow dye to binder ratio can be from about 0.3 to about 1.2, or from about 0.5 to about 1.0. A magenta dye to binder ratio can be from about 0.5 to about 1.5, or from about 0.8 to about 1.2. A cyan dye to binder ratio can be from about 1.0 to about 2.5, or from about 1.5 to about 2.0.

To form a dye-donor layer, one or more dyes can be dispersed in a polymeric binder, for example, a polycarbonate; a poly(styrene-co-acrylonitrile); a poly(sulfone); a poly (phenylene oxide); a cellulose derivative such as but not limited to cellulose acetate hydrogen phthalate, cellulose acetate, cellulose acetate propionate, cellulose acetate butyrate, or cellulose triacetate; or a combination thereof. The binder can be used in an amount of from about 0.05 $g/m^2$ to about 5 $g/m^2$.

The dye-donor element can include a stick preventative agent to reduce or eliminate sticking between the dye-donor element and the receiver element during printing. The stick preventative agent can be present in any layer of the dye-donor element, so long as the stick preventative agent is capable of diffusing through the layers of the dye-donor element to the dye-donor layer, or transferring from the slip layer to the dye-donor layer. For example, the stick preventative agent can be present in one or more patches of the dye-donor layer, in the support, in an adhesive layer, in a dye-barrier layer, in a slip layer, or in a combination thereof. According to various embodiments, the stick preventative agent can be in the slip layer, the dye-donor layer, or both. According to various embodiments, the stick preventative agent can be in the dye-donor layer. The stick preventative agent can be in one or more colored patches of the dye-donor layer, or a combination thereof. If more than one dye patch is present in the dye-donor layer, the stick preventative agent can be present in the last patch of the dye-donor layer to be printed, typically the cyan layer. However, the dye patches can be in any order. For example, if repeating patches of cyan, magenta, and yellow are used in the dye-donor element, in that respective order, the yellow patches, as the last patches printed in each series, can include the stick preventative agent. The stick preventative agent can be a silicone- or siloxane-containing polymer. Suitable polymers can include graft co-polymers, block polymers, co-polymers, and polymer blends or mixtures. Suitable stick preventative agents are described, for example, in commonly assigned U.S. application Ser. No. 10/667,065 to David G. Foster, et al., and Ser. No. 10/729,567 to Teh-Ming Kung, et al. Optionally, release agents as known to practitioners in the art can also be added to the dye-donor element, for example, to the dye-donor layer, the slip layer, or both. Suitable release agents include, for example, those described in U.S. Pat. Nos. 4,740,496, and 5,763,358.

According to various embodiments, the dye-donor layer can contain no plasticizer. Inclusion of the plasticizer in the dye-donor layer can increase dye-donor efficiency. The dye-donor layer can include plasticizers known in the art, such as those described in U.S. Pat. Nos. 5,830,824 and 5,750,465, and references disclosed therein. Suitable plasticizers can be defined as compounds having a glass transition temperature ($T_g$) less than 25° C., a melting point ($T_m$) less than 25° C., or both. Plasticizers useful for this invention can include low molecular weight plasticizers and higher molecular weight plasticizers such as oligomeric or polymeric plasticizers. Examples of suitable plasticizers can include aliphatic polyesters, epoxidized oils, chlorinated hydrocarbons, poly(ethylene glycols), poly(propylene glycols), and poly(vinyl ethyl ether) (PVEE). The molecular weight of the plasticizer can be greater than or equal to 450 to minimize transfer of the plasticizer to the dye-receiving layer during printing. Transfer of some plasticizers to the dye-receiving layer can result in image keeping and stability problems. The plasticizer can be present in an amount of from 1 to 50%, for example, from 5% to 35%, by weight of the binder.

Aliphatic polyesters suitable as plasticizers can be derived from succinic acid, glutaric acid, adipic acid, pimelic acid, suberic acid, azelaic acid, and sebacic acid. Suitable aliphatic polyesters can have one or more functional end groups, for example a carboxyl, hydroxyl, or alkoxyl group, where each alkoxyl group can be from 1 to 18 carbon atoms. Examples of suitable aliphatic polyesters can include Drapex plasticizers (Crompton/Witco Corporation, Middlebury, Conn., USA), such as Drapex 429, Admex plasticizers (Velsicol Chemical Corporation, Rosemont, Ill., USA) such as Admex 429, and Paraplex G25, Plasthall HA7A, Plasthall P650, Plasthall P-7092, all from CP Hall Company, Chicago, Ill., USA.

Epoxidized oils suitable as plasticizers can include partially or completely epoxidized natural oils, and partially or completely epoxidized derivatized natural oils such as epoxidized soybean oil sold as Paraplex G-60, Paraplex G-62, and Plasthall ESO; epoxidized linseed oil sold as Plasthall ELO; or epoxidized octyl tallate sold as Plasthall S-73, all from C. P. Hall Company.

Chlorinated hydrocarbons suitable for use as plasticizers can include long-chain hydrocarbons or paraffins consisting of methylene, methyl, methane, or alkene groups, any of which can have a chlorine substitution. The length of the long-chain hydrocarbon can be between 8 and 30 carbon atoms, for example, between 12 and 24 carbon atoms. The chains can be branched. The amount of chlorine in the paraffin can be between 25 and 75 wt %, for example, between 40 and 70 wt %. Mixtures of chlorinated paraffins can also be used. According to certain embodiments, the chlorinated paraffins can have the formula $C_xH_yCl_z$ wherein x is between 11 and 24, y is between 14 and 43, and z is between 3 and 10. Examples of suitable chlorinated hydrocarbons can include Chlorowax liquids sold by Occidental Chemical Corp., Dallas, Tex., USA, and Paroil paraffins sold by Dover Chemical Corp., Dover, Ohio, USA, such as Chlorowax 40 and Paroil 170HV.

Poly(ethylene glycols) and poly(propylene glycols) suitable for use as plasticizers can have unsubstituted end groups (OH), or they can be substituted with one or more functional groups such as an alkoxyl group or fatty acid, where each alkoxyl group or fatty acid can be from 1 to 18 carbon atoms. Examples of suitable poly(ethylene glycols) and poly(propylene glycols) can include TegMer 809 poly (ethylene glycol) from C. P. Hall Co., and PPG #483 poly(propylene glycol) from Scientific Polymer Products, Ontario, New York, USA.

The dye-donor layer can include beads. The beads can have a particle size of from 0.5 to 20 microns, preferably from 2.0 to 15 microns. The beads can act as spacer beads under the compression force of a wound up dye-donor roll, improving raw stock keeping of the dye-donor roll by reducing the material transferred from the dye-donor layer to the slipping layer, as measured by the change in sensitometry under accelerated aging conditions, or the appearance of unwanted dye in the laminate layer, or from the backside of the dye-donor element, for example, a slipping layer, to the dye-donor layer. The use of the beads can result in reduced mottle and improved image quality. The beads can be employed in any amount effective for the intended purpose. In general, good results have been obtained at a coverage of from 0.003 to 0.20 g/m$^2$. Beads suitable for the dye-donor layer can also be used in the slip layer.

The beads in the dye-donor layer can be crosslinked, elastomeric beads. The beads can have a glass transition temperature (Tg) of 45° C. or less, for example, 10° C. or less. The elastomeric beads can be made from an acrylic polymer or copolymer, such as butyl-, ethyl-, propyl-, hexyl-, 2-ethyl hexyl-, 2-chloroethyl-, 4-chlorobutyl- or 2-ethoxyethyl-acrylate or methacrylate; acrylic acid; methacrylic acid; hydroxyethyl acrylate; a styrenic copolymer, such as styrene-butadiene, styrene-acrylonitrile-butadiene, styrene-isoprene, or hydrogenated styrene-butadiene; or mixtures thereof. The elastomeric beads can be crosslinked with various crosslinking agents, which can be part of the elastomeric copolymer, such as but not limited to divinylbenzene; ethylene glycol diacrylate; 1,4-cyclohexylene-bis (oxyethyl)dimethacrylate; 1,4-cyclohexylene-bis(oxypropyl)diacrylate; 1,4-cyclohexylene-bis(oxypropyl) dimethacrylate; and ethylene glycol dimethacrylate. The elastomeric beads can have from 1 to 40%, for example, from 5 to 40%, by weight of a crosslinking agent.

The beads in the dye-donor layer can be hard polymeric beads. Suitable beads can include divinylbenzene beads, beads of polystyrene crosslinked with at least 20 wt. % divinylbenzene, and beads of poly(methyl methacrylate) crosslinked with at least 20 wt. % divinylbenzene, ethylene glycol dimethacrylate, 1,4-cyclohexylene-bis(oxyethyl)

dimethacrylate, 1,4-cyclohexylene-bis(oxypropyl) dimethacrylate, or other crosslinking monomers known to those familiar with the art.

The support can be formed of any material capable of withstanding the heat of thermal printing. According to various embodiments, the support can be dimensionally stable during printing. Suitable materials can include polyesters, for example, poly(ethylene terephthalate); polyamides; polycarbonates; glassine paper; condenser paper; cellulose esters, for example, cellulose acetate; fluorine polymers, for example, polyvinylidene fluoride, and poly (tetrafluoroethylene-cohexafluoropropylene); polyethers, for example, polyoxymethylene; polyacetals; polyolefins, for example, polystyrene, polyethylene, polypropylene, and methylpentane polymers; polyimides, for example, polyimide-amides and polyether-imides; and combinations thereof. Other suitable materials can include natural and synthetic papers, metal foils, fabric, or other materials capable of withstanding the heat or energy of the printing process. The support can have a thickness of from about 2 μm to about 30 μm, for example, from about 3 μm to about 7 μm.

According to various embodiments, a subbing layer, for example, an adhesive or tie layer, a dye-barrier layer, or a combination thereof, can be coated between the support and the dye-donor layer. The adhesive or tie layer can adhere the dye-donor layer to the support. Suitable adhesives are known to practitioners in the art, for example, Tyzor TBT® from E.I. DuPont de Nemours and Company. The dye-barrier layer can include a hydrophilic polymer. The dye-barrier layer can provide improved dye transfer densities.

The dye-donor element can also include a slip layer capable of preventing the print head from sticking to the dye-donor element. The slip layer can be coated on a side of the support opposite the dye-donor layer. The slip layer can include a lubricating material, for example, a surface-active agent, a liquid lubricant, a solid lubricant, or mixtures thereof, with or without a polymeric binder. Suitable lubricating materials can include oils or semi-crystalline organic solids that melt below 100° C., for example, poly(vinyl stearate), beeswax, perfluorinated alkyl ester polyether, poly (caprolactone), carbowax, polyethylene homopolymer, or poly(ethylene glycol). Suitable polymeric binders for the slip layer can include poly(vinyl alcohol-co-butyral), poly (vinyl alcohol-co-acetal), poly(styrene), poly(vinyl acetate), cellulose acetate butyrate, cellulose acetate, ethyl cellulose, and other binders as known to practitioners in the art. Other suitable lubricating materials are wax mixtures including two or more of a polymer derived from a polyolefin and an ethylenically unsaturated carboxylic acid or ester or anhydride thereof, a branched α-olefin polymer, and at least one other wax, as described, for example, in U.S. Patent Application Publications 2005-0009699 and 2005-0009700. The amount of lubricating material used in the slip layer is dependent, at least in part, upon the type of lubricating material, but can be in the range of from about 0.001 to about 12 $g/m^2$, although less or more lubricating material can be used as needed. If a polymeric binder is used, the lubricating material can be present in a range of 0.1 to 50 weight %, preferably 0.5 to 40 weight %, of the polymeric binder.

The dye-donor element can be a sheet of one or more colored patches or laminate, or a continuous roll or ribbon. The continuous roll or ribbon can include one patch of a monochromatic color or laminate, or can have alternating areas of different patches, for example, one or more dye patches of cyan, magenta, yellow, or black, one or more laminate patches, or a combination thereof.

The receiver element suitable for use with the dye-donor element described herein can be any receiver element as known to practitioners in the art. For example, the receiver element can include a support having thereon a dye image-receiving layer. The support can be a transparent film, for example, a poly(ether sulfone), a polyimide, a cellulose ester such as cellulose acetate, a poly(vinyl alcohol-co-acetal), or a poly(ethylene terephthalate). The support can be a reflective layer, for example, baryta-coated paper, white polyester (polyester with white pigment incorporated therein), an ivory paper, a condenser paper, or a synthetic paper, for example, DuPont Tyvek® by E.I. DuPont de Nemours and Company. The support can be employed at any desired thickness, for example, from about 10 μm to 1000 μm. Exemplary supports for the dye image-receiving layer are disclosed in commonly assigned U.S. Pat. Nos. 5,244,861 and 5,928,990, and in EP-A-0671281. Other suitable supports as known to practitioners in the art can also be used.

The dye image-receiving layer can be, for example, a polycarbonate, a polyurethane, a polyester, polyvinyl chloride, poly(styrene-co-acrylonitrile), poly(caprolactone), or combinations thereof. The dye image-receiving layer can be coated on the receiver element support in any amount effective for the intended purpose of receiving the dye from the dye-donor layer of the dye-donor element. For example, the dye image-receiving layer can be coated in an amount of from about 1 $g/m^2$ to about 5 $g/m^2$.

Additional polymeric layers can be present between the support and the dye image-receiving layer. For example, a polyolefin such as polyethylene or polypropylene can be present. White pigments such as titanium dioxide, zinc oxide, and the like can be added to the polymeric layer to provide reflectivity. A subbing layer optionally can be used over the polymeric layer in order to improve adhesion to the dye image-receiving layer. This can be called an adhesive or tie layer. Exemplary subbing layers are disclosed in U.S. Pat. Nos. 4,748,150, 4,965,238, 4,965,239, and 4,965241. An antistatic layer as known to practitioners in the art can also be used in the receiver element. The receiver element can also include a backing layer. Suitable examples of backing layers include those disclosed in U.S. Pat. Nos. 5,011,814 and 5,096,875.

The dye image-receiving layer, or an overcoat layer thereon, can contain a release agent, for example, a silicone or fluorine based compound, as is conventional in the art. Various exemplary release agents are disclosed, for example, in U.S. Pat. Nos. 4,820,687 and 4,695,286.

The receiver element can also include stick preventative agents, as described, for example, in commonly assigned copending U.S. Patent Application Publications U.S. 2005-0059551 A1 to David G. Foster, et al., and U.S. 2005-0059552 A1 to The-Ming Kung, et al. According to various embodiments, the receiver element and dye-donor element can include the same stick preventative agent.

The dye-donor element and receiver element, when placed in superimposed relationship such that the dye-donor layer of the dye-donor element is adjacent the dye image-receiving layer of the receiver element, can form a print assembly. An image can be formed by passing the print assembly past a print head, wherein the print head is located on the side of the dye-donor element opposite the receiver element. The print head can apply heat image-wise to the dye-donor element, causing the dyes in the dye-donor layer to transfer to the dye image-receiving layer of the receiver element.

Thermal print heads that can be used with the print assembly are available commercially and known to practitioners in the art. Exemplary thermal print heads can include, but are not limited to, a Fujitsu Thermal Head (FTP-040 MCSOO1), a TDK Thermal Head F415 HH7-1089, a Rohm Thermal Head KE 2008-F3, a Shinko head (TH300U162P-001), and Toshiba heads (TPH162R1 and TPH207R1A).

The methods described herein can be used to form images with a print density greater than or equal to 2.0. The methods can be used for high speed printing, for example, printing at a line time of less than 4.0 msec/line or less, for example, 2.0 msec/line or less.

EXAMPLES

Example 1

A dye donor element was prepared using RESS coating of the dye layer on 6 micron poly(ethylene terephthalate) support:

(1) a subbing layer of a titanium alkoxide (duPont Tyzor TBT®) (0.12 g/m$^2$) from n-propyl acetate and n-butyl alcohol solvent mixture, and (2) a dye layer was deposited using a compressed carbon dioxide dispersion method at constant temperature (60° C.) and pressure (300 Bar), the dye was sprayed through 500 micron capillary. The coated colorant had the following structure:

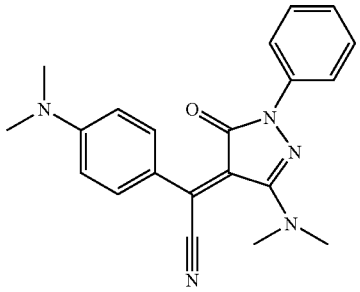

A dye donor slipping layer side was prepared by coating the following layers in the order recited on the 6 micron poly(ethylene terephthalate) support:

(1) a subbing layer of a titanium alkoxide (duPont Tyzor TBT®) (0.12 g/m2) from n-propyl acetate and n-butyl alcohol solvent mixture, and (2) a slipping layer containing an aminopropyl-dimethyl-terminated polydimethylsiloxane, PS513® (United Chemical Technologies) (0.01 g/m$^2$), a poly(vinyl acetal) binder (0.38 g/m$^2$) (Sekisui KS-1), p-toluenesulfonic acid (0.0003 g/m$^2$) and candellila wax (0.02 g/m$^2$) coated from a solvent mixture of diethylketone, methanol and distilled water (88.7/9.0/2.3).

A receiver element as shown below was prepared, having an overall thickness of about 220 μm and a thermal dye receiver layer thickness of about 3 μm.

| RECEIVER ELEMENT |
|---|
| 4–8 μm divinyl benzene beads and solvent coated cross-linked polyol dye receiving layer |
| Subbing layer |
| Microvoided composite film OPPalyte 350 K18 (ExxonMobil) |
| Pigmented polyethylene |
| Cellulose Paper |
| Polyethylene |
| Polyproplene film |

The dye side of the dye-donor element was placed in contact with the dye-receiving element of the same width and both were fastened to a stepper motor driven pulling device. The imaging electronics were activated causing the pulling device to draw the assemblage of donor and receiver placed together between the printing head and a roller at a rate of about 5.14 mm/sec. The voltage supplied to the print was 15.75 volts. After printing the donor and receiver were separated manually. The printed image was a density gradient ranging from 0.07 to 1.46.

Example 2

A dye donor element was prepared using SAS coating of the dye layer on aluminum foil. The dye was Disperse Red 60 in acetone. A receiver element as described in Example 1 was used.

The dye side of the dye-donor element was placed in contact with the dye-receiving element of the same width and both were fastened to a stepper motor driven pulling device. The imaging electronics were activated causing the pulling device to draw the assemblage of donor and receiver placed together between the printing head and a roller at a rate of about 5.14 mm/sec. The voltage supplied to the print was 15.75 volts. After printing the donor and receiver were separated manually. The printed image was a density gradient ranging from 0 to 1.46.

The invention has been described in detail with particular reference to certain preferred embodiments thereof, but it will be understood that variations and modifications can be effected within the spirit and scope of the invention.

It is claimed:

1. A method of forming an image, comprising:

forming a dye donor element comprising a support and dye donor layer comprising a colorant composition formed on the support by depositing the colorant composition comprising a colorant and a compressed fluid carrier on the support;

obtaining a receiver;

superposing the dye donor layer of the dye donor element and the receiver;

imagewise transferring colorant from the dye donor layer of the dye donor element to the receiver.

2. The method of claim 1, wherein imagewise transferring the colorant comprises applying heat, pressure, radiation, or a combination thereof to the dye donor element on a side opposite the dye donor layer.

3. The method of claim 1, wherein imagewise transferring the colorant comprises thermal printing.

4. The method of claim 3, wherein thermal printing comprises resistive head or laser thermal printing.

5. The method of claim 1, wherein imagewise transferring of the colorant from the dye donor layer to the receiver is at a speed of less than 4.0 msec/line.

6. The method of claim 1, wherein imagewise transferring of the colorant from the dye donor layer to the receiver is at a speed of 2.0 msec/line or less.

7. The method of claim 1 wherein said coating the support with the colorant composition comprises spraying the colorant composition on the support.

* * * * *